US007544047B2

(12) United States Patent
Nakane et al.

(10) Patent No.: US 7,544,047 B2
(45) Date of Patent: Jun. 9, 2009

(54) COMPRESSOR WITH TWO COOLING CHAMBERS

(75) Inventors: Yoshiyuki Nakane, Kariya (JP); Hidefumi Mori, Kariya (JP); Tatsuyuki Hoshino, Kariya (JP); Kazuho Yamada, Kariya (JP); Tsutomu Nasuda, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 767 days.

(21) Appl. No.: 10/812,763

(22) Filed: Mar. 29, 2004

(65) Prior Publication Data

US 2004/0191100 A1 Sep. 30, 2004

(30) Foreign Application Priority Data

Mar. 31, 2003 (JP) ..... 2003-097045

(51) Int. Cl.
*F04B 39/02* (2006.01)
*F04B 39/06* (2006.01)

(52) U.S. Cl. ..... 417/372; 417/410.5; 418/55.1; 418/83

(58) Field of Classification Search ..... 418/55.1, 418/83; 417/372, 410.5
See application file for complete search history.

(56) References Cited

U.S. PATENT DOCUMENTS 2,150,122 A 3/1939 Kollberg et al.
3,151,672 A * 10/1964 Edmund ..... 165/143
3,211,362 A * 10/1965 Laskey et al. ..... 417/407
3,608,629 A * 9/1971 Cowans ..... 165/165
3,994,633 A * 11/1976 Shaffer ..... 418/5
4,615,384 A * 10/1986 Shimada et al. ..... 165/152
5,494,424 A * 2/1996 Schnell ..... 418/83
5,626,188 A * 5/1997 Dewar et al. ..... 165/166
6,503,069 B2 * 1/2003 Moroi et al. ..... 418/55.1
2002/0025268 A1 * 2/2002 Moroi et al. ..... 418/55.1
2002/0071779 A1 6/2002 Moroi et al. ..... 418/55.1
2002/0102173 A1 8/2002 Okada et al. ..... 418/55.1

FOREIGN PATENT DOCUMENTS

JP 61200391 A * 9/1986
JP 2002-106484 4/2002
JP 2002-295386 10/2002

* cited by examiner

*Primary Examiner*—Devon C Kramer
*Assistant Examiner*—Patrick Hamo
(74) *Attorney, Agent, or Firm*—Locke Lord Bissell & Liddell LLP

(57) ABSTRACT

A compressor, which is cooled by cooling medium, includes a compression chamber, a first cooling chamber and a second cooling chamber. In the compression chamber, gas is compressed and then discharged therefrom. The first cooling chamber, in which the cooling medium flows, is provided so as to adjoin the compression chamber for cooling the gas in the compression chamber. The second cooling chamber adjoins the first cooling chamber. The second cooling chamber has a gas passage in which the discharged gas flows and a medium passage in which the cooling medium flows. The medium passage is arranged so as to restrain transmission of heat of the discharged gas in the gas passage to the cooling medium in the first cooling chamber.

23 Claims, 5 Drawing Sheets

COMPRESSOR WITH TWO COOLING CHAMBERS

BACKGROUND OF THE INVENTION

The present invention relates to a compressor which compresses gas supplied, for example, to a fuel cell.

Japanese Unexamined Patent Publication No. 2002-295386 discloses a compressor having a gas cooler in which discharge gas discharged from compression chambers is cooled in order to protect piping provided downstream of the compressor against heat (See pages 3 to 5 and FIG. 1 of the reference). The compressor of the above reference is a scroll type compressor which is provided with a back cooling chamber at the back of a fixed scroll member of the compressor. The gas cooler in which the discharge gas flows is disposed so as to adjoin the back cooling chamber. The gas cooler is constructed specifically such that both of gas in the compression chambers and the discharge gas in the gas cooler are cooled by cooling water that serves as cooling medium which flows in the back cooling chamber.

In the above reference, however, since the cooling water in the back cooling chamber is heated by heat of the discharge gas, the gas in the compression chambers tends to be hard to be cooled, so that there has been a fear that the efficiency of cooling the discharge gas is reduced. In addition, there has been another fear that the gas in the compression chambers is not cooled sufficiently by the cooling water in the back cooling chamber, but on the contrary it is heated by the cooling water in the back cooling chamber when temperature of the cooling water in the back cooling chamber becomes higher than that of the gas in the compression chambers by the heat of the discharge gas. The contact area (or heat radiation area) over which the back cooling chamber and the gas cooler are placed in contact with each other through a partition wall tends to be increased with the need to cool the discharge gas in the gas cooler. As the contact area is increased, however, the cooling water in the back cooling chamber tends to be heated by the heat of the discharge gas.

SUMMARY OF THE INVENTION

The present invention is directed to a compressor which improves discharge gas cooling efficiency while restraining a decrease in the efficiency of cooling the gas in a compression chamber.

The present invention has the following features. A compressor, which is cooled by cooling medium, includes a compression chamber, a first cooling chamber and a second cooling chamber. In the compression chamber, gas is compressed and then discharged therefrom. The first cooling chamber, in which the cooling medium flows, is provided so as to adjoin the compression chamber for cooling the gas in the compression chamber. The second cooling chamber adjoins the first cooling chamber. The second cooling chamber has a gas passage in which the discharged gas flows and a medium passage in which the cooling medium flows. The medium passage is arranged so as to restrain transmission of heat of the discharged gas in the gas passage to the cooling medium in the first cooling chamber.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first preferred embodiment will be now described with reference to FIGS. 1 through 4. The present preferred embodiment is applied to a compressor, and is more particularly applied to an electric scroll type compressor usable for a fuel cell in an electric vehicle.

Figure 1:
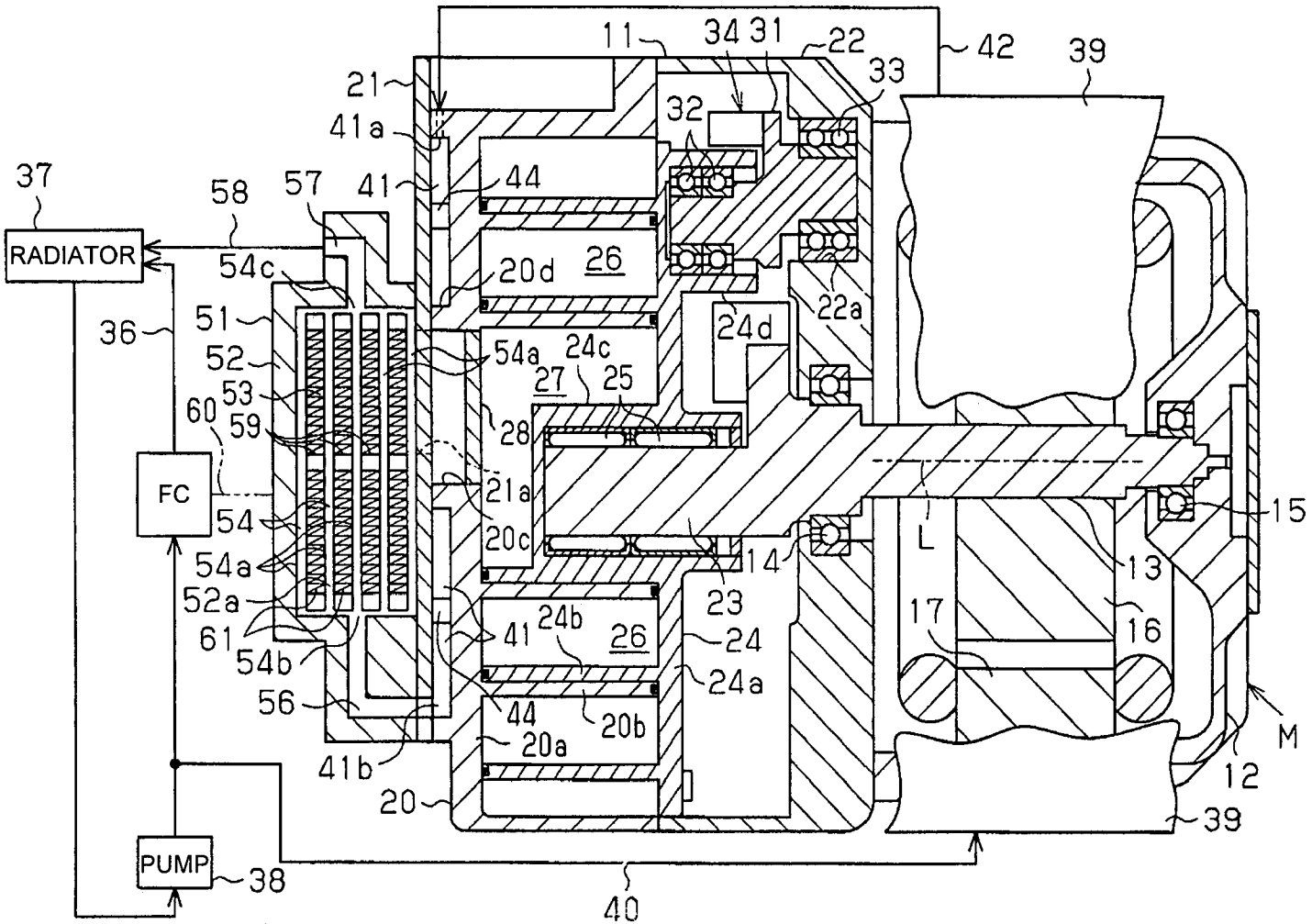
FIG. 1 is a schematic sectional view showing an electric scroll type compressor and a channel of cooling water according to a first preferred embodiment of the present invention.

Referring to FIG. 1, an electric scroll type compressor that serves as a scroll type compressor compresses gas which is supplied to a fuel cell FC in an electric vehicle. Hereinafter, the electric scroll type compressor is merely referred to a compressor. Specifically, in the present preferred embodiments, the compressor is used for compressing air which is supplied to the fuel cell FC.

The compressor speed is so controlled that the compressor increases the amount of air which is supplied to the fuel cell FC for a given length of time with an increasing of running speed of the electric vehicle while it decreases the amount of air with a decrease of the running speed of the electric vehicle. Further, even in a state when the electric vehicle is at a stop for a red traffic signal, the compressor continues to be driven at a relatively low speed in order to operate other electrical equipment such as an electric type refrigerant compressor for an air conditioning apparatus. In FIG. 1, the left side of the compressor is the front side and the right side thereof is the rear side, respectively.

Now, the structure of the compressor will be described. Still referring to FIG. 1, the compressor includes a compression mechanism and an electric motor. A housing of the compressor or a compressor housing includes a first housing unit 11 on the compression mechanism side and a second housing unit 12 joined to the rear end of the first housing unit 11 on the electric motor side. The first housing unit 11 and the second housing unit 12 are made of aluminum or aluminum alloy. A rotary shaft 13 is supported by a bearing 14 in the first housing unit 11 and a bearing 15 in the second housing unit 12 for rotation in the compressor housing.

In the second housing unit 12, an electric motor M is provided which includes a rotor 16 fixedly mounted on the rotary shaft 13 for rotation therewith and a stator 17 fixed on the inner peripheral surface of the second housing unit 12 so as to surround the rotor 16.

The first housing unit 11 includes a fixed scroll member 20, a front housing member 21 and a rear housing member 22. The front end of the fixed scroll member 20 is fixedly joined to the rear end of the front housing member 21. The rear end of the fixed scroll member 20 is fixedly joined to the front end of the rear housing member 22. The fixed scroll member 20 has a fixed base plate 20*a* and a fixed spiral wall 20*b* that extends from the rear surface of the fixed base plate 20*a*.

A main crankshaft 23 extends frontward from the front end of the rotary shaft 13 and is offset from the axis L of the rotary shaft 13 by a predetermined distance of eccentricity. A movable scroll member 24 is rotatably supported by the main crankshaft 23 through a bearing 25 so as to face the fixed scroll member 20.

The movable scroll member 24 includes a movable base plate 24*a* that is substantially disc-shaped and a movable spiral wall 24*b* that extends from the front surface of the movable base plate 24*b*. The fixed and movable scroll members 20 and 24 are arranged so as to engage with each other. The distal end surfaces of the fixed and movable spiral walls 20*b* and 24*b* are in contact with the facing movable and fixed base plates 24*a* and 20*a*, respectively. The fixed spiral wall 20*b* overlaps the movable spiral wall 24*b* to contact each other at a plurality of points. Therefore, the fixed base plate 20*a* and the fixed spiral wall 20*b* of the fixed scroll member 20 as well as the movable base plate 24*a* and the movable spiral wall 24*b* of the movable scroll member 24 define a plurality of compression chambers 26 that serves as enclosed space.

A cylinder 24*c* protrudes axially from the intermediate portion of the movable base plate 24*a* toward the front and rear sides of the compressor so as to receive therein the main crankshaft 23. The cylinder 24*c* is closed at its front end by a bottom wall and open at its rear end. Thus, the main crankshaft 23 protrudes in the cylinder 24*c* from the movable base plate 24*a* toward the fixed base plate 20*a*. Consequently, the compressor is shortened along the axis L of the rotary shaft 13 by a length of the main crankshaft 23 that protrudes from the movable base plate 24*a* toward the fixed base plate 20*a*.

A discharge port 20*c* is formed in the scroll member 20 substantially at the center of the fixed base plate 20*a*. An outlet 21*a* is formed substantially at the center of the front housing member 21 on the front side of the fixed scroll member 20. The fixed scroll member 20 and the movable scroll member 24 define a central chamber 27 substantially at a central part of the scroll of the fixed spiral wall 20*b* on the rear side of the fixed scroll member 20. The discharge port 20*c* interconnects the outlet 21*a* with the central chamber 27. An air filter 28 is arranged in the discharge port 20*c*.

Three bosses 24*d* are formed on the movable base plate 24*a* of the movable scroll member 24, extending from the back of the movable base plate 24*a* or from the rear surface thereof (only one boss 24*d* is shown in FIG. 1). The bosses 24*d* are arranged at intervals of 120° in a circumferential direction of the movable base plate 24*a*. An auxiliary crankshaft 31 is rotatably supported by each boss 24*d* through a bearing 32. Three recesses 22*a* are formed in the front surface of the rear housing member 22 so as to face the respective bosses 24*d*. A bearing 33 is provided in each recess 22*a* for rotatably supporting the corresponding auxiliary crankshaft 31. The auxiliary crankshafts 31, the bearings 32 and 33, the bosses 24*d*, and the recesses 22*a* constitute a self-rotation preventing mechanism 34.

Now, a channel of cooling water that serves as a cooling medium in the electric vehicle and a channel of gas discharged from the compression chamber 26 will be described.

The electric vehicle is provided with a circulation channel 36 of the cooling water for cooling the fuel cell FC. The circulation channel 36 includes a radiator 37 and a water pump 38. The radiator 37 serves as a heat exchanger. The cooling water whose temperature has been increased by cooling the fuel cell FC is cooled down by the radiator 37 and then fed by the water pump 38 to cool the fuel cell FC. Thus, the cooling water recirculates in the channel for cooling the fuel cell FC.

The electric motor M is covered by a water jacket 39 that serves as a motor cooling member. A part of the cooling water in the circulation channel 36 is supplied into the water jacket 39 through a passage 40 which is diverged from the circulation channel 36 between the water pump 38 and the fuel cell FC. Thus, the electric motor M is cooled.

In the fixed scroll member 20, the front surface of the fixed base plate 20*a*, or the back of the fixed base plate 20*a* with respect to the compression chambers 26, is formed with recesses. The recessed portions of the front surface of the fixed base plate 20*a* are covered with the front housing member 21 thereby to define a back cooling chamber 41 for cooling the compression chambers 26. The cooling water which has passed through the water jacket 39 flows into this back cooling chamber 41 through a passage 42.

The back cooling chamber 41 is arranged to adjoin the compression chambers 26, so that heat exchange is performed between the cooling water in the back cooling chamber 41 and the air in the compression chambers 26, with the result that the air in the compression chambers 26 is cooled and, therefore, temperature rise of the air in the compression chambers 26 is regulated.

Figure 2:
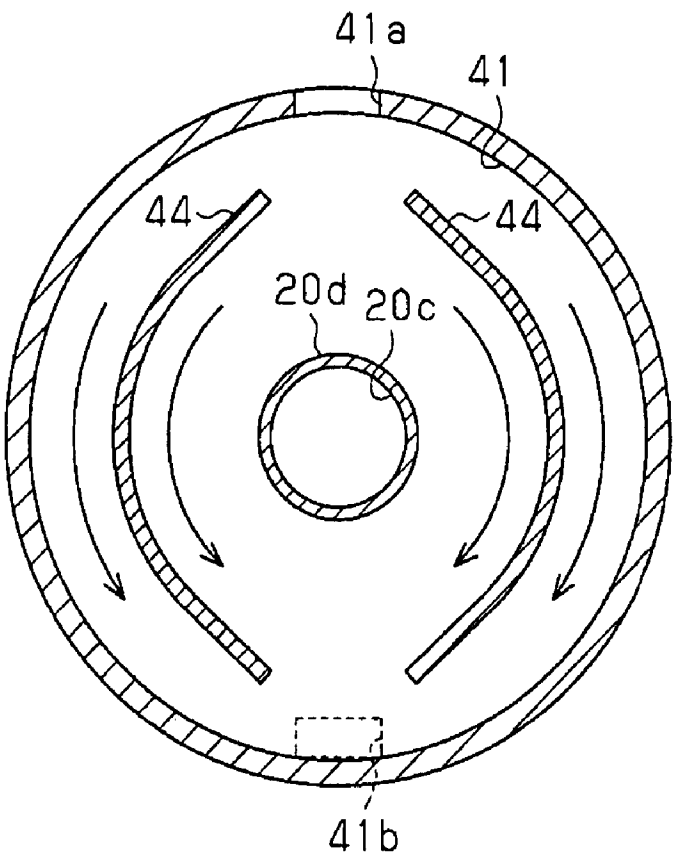
FIG. 2 is a schematic sectional view showing the flow of the cooling water in a back cooling chamber according to the first preferred embodiment of the present invention.

An inlet 41*a* of the back cooling chamber 41 is formed on the upper side and an outlet 41*b* of the back cooling chamber 41 is formed on the lower side of the cooling chamber 41, respectively, as seen in FIG. 1. As shown in FIG. 2, a pair of guiding walls 44 is formed in the back cooling chamber 41. Each guiding wall 44 is formed to extend substantially halfway around a cylindrical wall 20*d* which defines the discharge port 20*c*, between the inlet 41*a* and the outlet 41*b*. Therefore, the cooling water flowing into the back cooling chamber 41 from the inlet 41*a* is divided into two flows of cooling water. Each flow of the cooling water moves halfway around the cylindrical wall 20*d* while being guided by the corresponding guiding wall 44, and then moves out of the back cooling chamber 41 through the outlet 41*b*.

Figure 3:
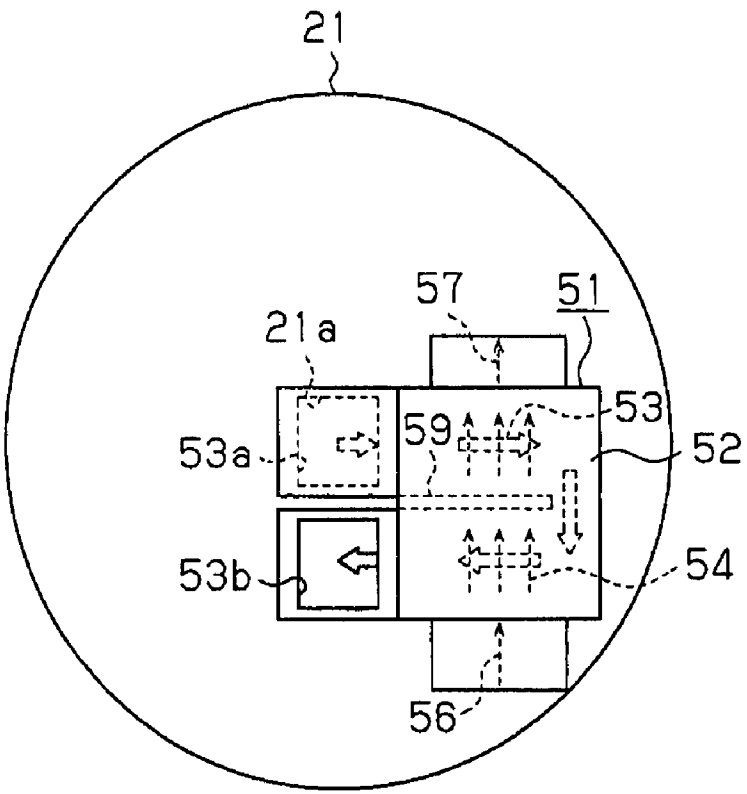
FIG. 3 is a schematic front view showing the compressor according to the first preferred embodiment of the present invention.

As shown in FIGS. 1 and 3, an inter-cooler 51 is arranged on the front surface of the front housing member 21. The name of "inter-cooler" is given for the reason of cooled gas which flows into a device (or the fuel cell FC in the present preferred embodiment) located downstream in the compressor. The inter-cooler 51 is arranged in an offset relation to the center of the front housing member 21. Specifically, the inter-cooler 51 is offset downward on the front housing member 21 and toward the reader as seen on FIG. 1 (or rightward as seen on FIG. 3). The inter-cooler 51 is integrated with the compressor.

A case 52 of the inter-cooler 51 has a shape of box and is opened at one end. The opening of the case 52 is covered by the front housing member 21 thereby to define an internal space of the case 52 that serves as a discharge-gas cooling chamber 52*a*.

Figure 4:
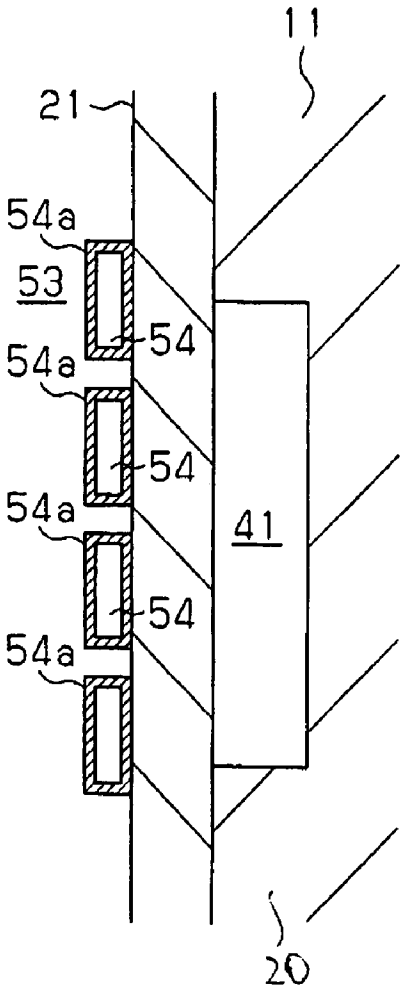
FIG. 4 is a partially enlarged schematic sectional view showing positional relationship between tubes and the back cooling chamber according to the first preferred embodiment of the present invention.

A gas passage 53 and a medium passage 54 are formed in the internal space of the case 52. The gas, or air in the present preferred embodiment, discharged from the compression chambers 26 flows into the gas passage 53. The cooling medium, or cooling water in the present preferred embodiment, flows into the medium passage 54. A plurality of branched tubes 54*a* extends vertically in the case 52. As shown in FIG. 4, each tube 54*a* is flat in cross-section and the outer shell thereof has a predetermined thickness. For the sake of illustration, the outer shell of the tubes 54*a* is depicted by lines in FIG. 1. It is so arranged that the medium passage 54 through which the cooling water flows is provided by the internal space of the tubes 54*a* and the gas passage 53 through which the discharged gas or air flows is provided by the space outside the tubes 54*a* in the case 52.

As shown in FIGS. 1 and 4, the tubes 54*a* on the side of the back cooling chamber 41 are provided so as to adjoin the front housing member 21 and in separated manner. Therefore, the gas passage 53 does not adjoin the back cooling chamber 41 in a place where the tubes 54*a* adjoining the front housing member 21 exist.

An inlet 54*b* of the medium passage 54 is formed at the bottom of the inter-cooler 51 and connected to the outlet 41*b* of the back cooling chamber 41 by an inflow passage 56. An outlet 54*c* of the medium passage 54 is formed at the top of the inter-cooler 51 and connected to the radiator 37 by an outflow passage 57 and a passage 58.

The gas passage 53 is formed such that the gas or air flows around a wall 59, which is formed extending perpendicularly to the plane of FIG. 1 or in a horizontal direction in FIG. 3, from the upper region of the wall 59 and turns back at one end of the wall 59 to the lower region thereof, as indicated by outlined arrows in FIG. 3. As shown in FIG. 3, an inlet 53*a* of the gas passage 53 is formed at the top of the inter-cooler 51, and although it is hidden on the further side of the inter-cooler 51 in FIG. 1. The inlet 53*a* is connected to the outlet 21*a*. As shown in FIG. 3, an outlet 53*b* is formed on the lower side of the inter-cooler 51, or below the inlet 53*a*. The outlet 53*b* is opened frontward and connected to the fuel cell FC through a rubber hose 60 that serves as a piping located downstream in the compressor which includes the inter-cooler 51.

As shown in FIG. 1, fins 61 are arranged in the gas passage 53. The fins 61 are in contact with the tubes 54*a* and arranged in zigzag manner between any two adjacent tubes 54*a*.

Now, the function of the aforementioned compressor will be described.

As the rotary shaft 13 is rotated by the electric motor M, the movable scroll member 24 orbits around the axis L of the rotary shaft 13 by the main crankshaft 23. At the same time, the self-rotation preventing mechanism 34 prevents the movable scroll member 24 from self-rotating while it allows the movable scroll member 24 to orbit around the axis L of the rotary shaft 13. As the compression chambers 26 are moved inwardly from the outer periphery of the fixed and movable spiral walls 20*b* and 24*b* by the orbital movement of the movable scroll member 24, the compression chambers 26 reduce in volume.

In the compressor, the air which is supplied to the compressor is introduced from the outer peripheral side of the fixed and movable spiral walls 20*b* and 24*b* into the compression chambers 26. Subsequently, the air is compressed by the aforementioned movement of the compression chambers 26. The compressed air is discharged from the compression chambers 26, which have then approached the center of the fixed base plate 20*a*, through the central chamber 27, the discharge port 20*c* and the outlet 21*a*. The air discharged from the compression chambers 26 through the outlet 21*a* then flows from the inlet 53*a* into the gas passage 53 of the inter-cooler 51. In the gas passage 53, the air flows as shown by outlined arrows in FIG. 3. The air in the gas passage 53 flows out from the outlet 53*b* to be supplied to the fuel cell FC through the rubber hose 60.

On the other hand, the cooling water cooled by the radiator 37, pressurized by the water pump 38 and flown to the passage 40 is supplied to the water jacket 39, thereby to cool the electric motor M. The cooling water, which has passed through the water jacket 39, then flows into the back cooling chamber 41 through the passage 42. In the back cooling chamber 41, the cooling water flows as shown by arrows in FIG. 2 thereby to cool the air which is introduced into the compression chambers 26 and being compressed. Even if the electric motor M generates heat during its operation, since the temperature of the heated electric motor M is lower than that of the air introduced into the compression chambers 26 and being compressed therein, the air in the compression chambers 26 is cooled sufficiently.

The cooling water which has passed through the back cooling chamber 41 and out from the outlet 41*b* flows into the medium passage 54 through the inflow passage 56 and the inlet 54*b* as shown by arrows in FIG. 3. The cooling water, which has been supplied into the medium passages 54, is divided into the plurality of tubes 54*a* to cool the discharge air in the gas passage 53. The heat exchange between the cooling water in the medium passage 54 and the discharge air in the gas passage 53 is performed through the outer shell of the tubes 54*a* and the fins 61. Since the temperature of the air in the compression chambers 26 is lower than that of the discharge air, the discharge air is cooled by the cooling water sufficiently.

The cooling water in the tubes 54*a* which adjoins the front housing member 21 absorbs heat of the discharge air in the gas passage 53. Thus, transmission of heat of the discharge air in the gas passage 53 to the back cooling chamber 41 is reduced. The discharge air in the gas passage 53 is cooled to such a temperature at which the rubber hose 60 can perform its function properly without deteriorating its quality.

Flows of the cooling water which has passed through the medium passage 54 join together at the top of the inter-cooler 51 and returned to the radiator 37 through the inflow passage 57 and the outflow passage 58 to be cooled. The cooling water which has been cooled by the radiator 37 is fed again to the fuel cell FC by the water pump 38 for cooling the fuel cell FC. The cooling water, which has been cooled by the radiator 37, is fed also to the water jacket 39, by the water pump 38.

The present preferred embodiment achieves the following advantageous effects.

(1) As mentioned above, the cooling water flows through the back cooling chamber 41 to cool the air in the compression chambers 26, whereupon the cooling water flows through the tubes 54*a*, which constitute the medium passage 54, to cool the discharge air. Therefore, the discharge air whose temperature is higher than that of the air in the compression chambers 26 is cooled sufficiently.

(2) The tubes 54*a* on the side of the back cooling chamber 41 are provided so as to adjoin the front housing member 21 and, therefore, transmission of the heat of the discharge air in the gas passage 53 to the cooling water in the back cooling chamber 41 is reduced. Thus, a decrease in efficiency of cooling the air in the compression chambers 26 due to the heat of discharge air is prevented and, further, the cooling efficiency of the discharge air is improved. Therefore, the discharge air, when it has passed the inter-cooler 51 and discharged out of the compressor, is cooled sufficiently to such an extent that the temperature of the discharge air will not cause the rubber hose 60 to deteriorate.

(3) The cooling water flows into the back cooling chamber 41 after flowing into the water jacket 39 to cool the electric motor M. Since the temperature of the electric motor M is lower than that of the air in the compression chambers 26 even when the electric motor M generates heat during its operation, the air in the compression chambers 26 and the discharge air are cooled sufficiently. In addition, as compared with a case wherein the piping for feeding the cooling water to the water jacket 39 and the piping for feeding the cooling water to the back cooling chamber 41 and the inter-cooler 51 are provided separately, a piping for returning the cooling water from the water jacket 39 to the radiator 37 does not need to be arranged in the above-described preferred embodiment. Thus, the length of the piping for use in the compressor is shortened and, therefore, complicated piping arrangement is avoided.

(4) The compressor compresses gas, or air in the present preferred embodiment of the present invention, which is to be supplied to the fuel cell FC. In view of heat resistance problem of the fuel cell FC, the high-temperature air discharged from the compressor needs to be cooled. The compressor according to the present preferred embodiment of the present invention, which has the gas passage 53 and the medium passage 54, can improve the efficiency of cooling the discharge air while limiting a decrease in efficiency of cooling the air in the compression chambers 26. Therefore, the compressor according to the present preferred embodiment is advantageously applicable to the fuel cell.

(5) It is so arranged in the preferred embodiment of the present invention that the medium passage 54 includes a plurality of branched tubes 54*a* through which the cooling water flows and that the discharge air flows through the gas passage 53 outside the tubes 54*a*. Since the fins 61 are arranged in the gas passage 53, the efficiency of cooling the discharge air is improved. In addition, the gas passage 53 can be easily widened since it is arranged outside the tubes 54*a*, in comparison with a case that in contrast the discharge gas flows inside the tubes 54*a* and that the cooling water flows outside the tubes 54*a*, thus allowing the discharge air to flow easily. Thus, increase of workload of the compressor can be easily restrained.

(6) The compressor of the present preferred embodiment is designed to compress air supplied to the fuel cell used for an electric vehicle. In the electric vehicle, since space allowed for the aforementioned compressor quite limited and, therefore, compactness of the inter-cooler 51 is strongly needed. Therefore, the arrangement of the fins 61 enables the inter-cooler 51 to be made compact and also helps to improve the efficiency of cooling the air in the compression chambers 26.

(7) The back cooling chamber 41 is arranged in such a manner that the cooling water is divided into two flows and each flow moves halfway around the cylindrical wall 20d while being guided by the corresponding guiding wall 44. In comparison with a case wherein the inlet 41*a* and the outlet 41*b* of the back cooling water 41 are disposed so as to adjoin each other and the guiding wall 44 is formed substantially circular around the cylindrical wall 20*d* so that the cooling water moves substantially all the way around the wall 20*d*, the flow path for the cooling water in the illustrated preferred embodiment of the present invention is shorter and the pressure loss can be reduced, accordingly. Therefore, the flow path of the cooling water in the back cooling chamber 41 can be narrowed while an increase of the pressure loss of the cooling water is prevented. Additionally, the length of the back cooling chamber 41 in the direction of the axis L can be shortened and, therefore, increase of the size of the compressor with the inter-cooler 51 integrated therewith can be prevented.

Figure 5:
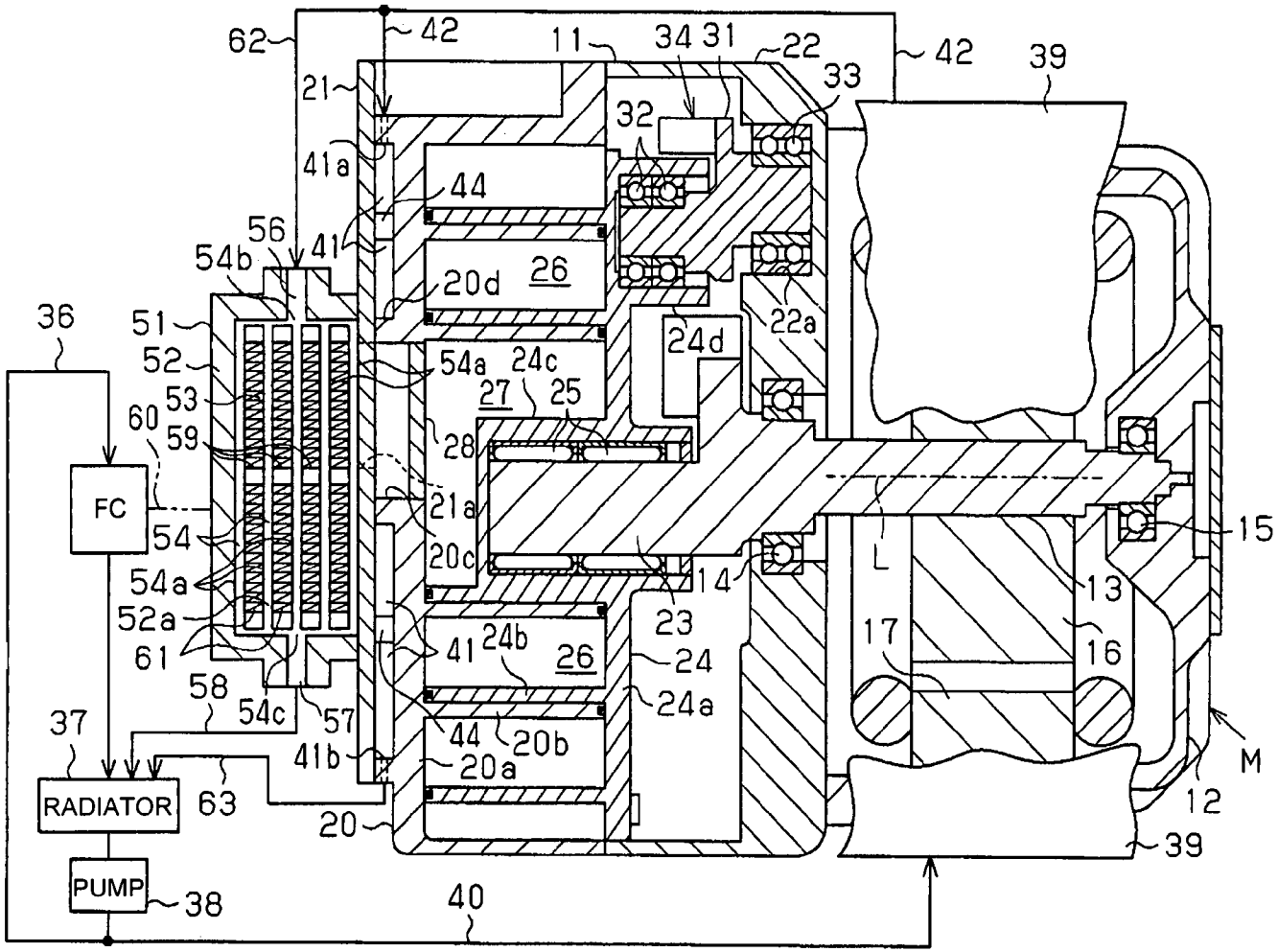
FIG. 5 is a schematic sectional view showing an electric scroll type, compressor and a channel of cooling water according to a second preferred embodiment of the present invention.

A second preferred embodiment of the present invention will be now described with reference to FIG. 5. The present preferred embodiment is applied to a compressor, and more particularly applied to an electric scroll type compressor for use with the fuel cell in the electric vehicle. Only the differences between the first preferred embodiment and the second preferred embodiment will be described in the following. The same reference numerals of the first preferred embodiment are applied to substantially the same components in the second preferred embodiment and overlapped description is omitted. Referring to FIG. 5, the second embodiment of the drawing differs from the first embodiment in that the cooling water flows into the back cooling chamber 41 and the medium passage 54 so as to be divided into two flows.

The inlet 54*a* of the medium passage 54 is connected to the water jacket 39 through a passage 62 which is branched off from the passage 42 which connects the water jacket 39 to the back cooling chamber 41. Therefore, the cooling water which has flowed through the water jacket 39 is divided into two flows, one flowing into the back cooling chamber 41 and the other into the inter-cooler 51. In FIG. 5, the inlet 54*b* of the medium passage 54 is formed at the top, and the outlet 54*c* at the bottom, respectively. The outlet 41*b* of the back cooling chamber 41 is connected to the radiator 37 by the passage 63, so that the cooling water which has flowed through the back cooling chamber 41 flows into the radiator 37 through the passage 63.

In the second preferred embodiment, the above-described effects (2) through (7) of the first preferred embodiment are substantially obtained. In addition, the following effect (8) is also obtainable.

(8) The cooling water is divided into two flows, flowing into the back cooling chamber 41, as well as into the medium passage 54. Therefore, since the cooling water which flows into the medium passage 54 does not cool the air in the compression chambers 26, the discharge air can be cooled by cooling water whose temperature is lower than the cooling water of the first preferred embodiment, so that the cooling efficiency can be further.improved. In addition, load applied to the water pump 38 is reduced because the length of the channel of the cooling water between the water jacket 39 and the radiator 37 is shortened by the divided flow of the cooling water in comparison with a case wherein the length of the channel of the back cooling chamber 41 is added to that of the medium passage 54 in the first preferred embodiment.

In the present embodiment, the following alternative embodiments are also practiced.

Figure 6:
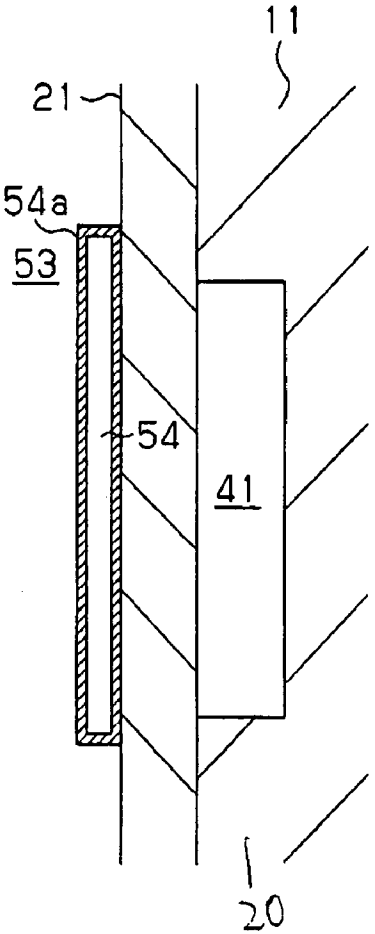
FIG. 6 is a partially enlarged schematic sectional view showing positional relationship between tubes and the back cooling chamber according to another preferred embodiment of the present invention.

In the above-described embodiments, the tubes 54*a*, which adjoin the front housing member 21, are arranged separately. The gas passage 53 and the back cooling chamber 41 are arranged so as not to partially adjoin each other. In alternative embodiments to the embodiments, the tube 54*a* is arranged in such a manner that the gas passage 53 and the back cooling chamber 41 do not adjoin each other. As shown in FIG. 6, the passage of the tube 54*a* is widened and arranged in such a manner that the tube 54*a* is present over the region where the back cooling chamber 41 and the gas passage 53 face each other.

Figure 7:
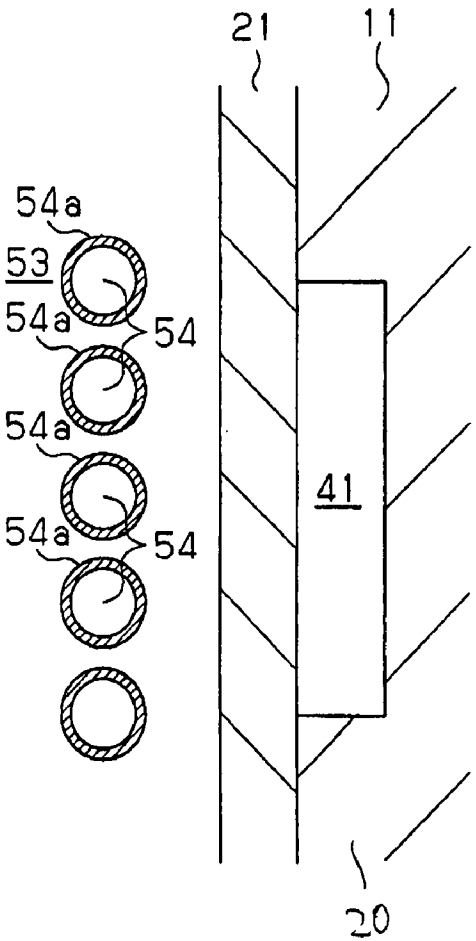
FIG. 7 is a partially enlarged schematic sectional view showing positional relationship between tubes and the back cooling chamber according to yet another preferred embodiment of the present invention.

In the above-described embodiments, at least one tube 54*a* is disposed so as to adjoin the front housing member 21. However, the arrangement of the tube 54*a* is not limited to such arrangement, but the tube 54*a* is disposed in such a manner that the transmission of heat of the discharge air to the cooling water in the back cooling chamber 41 by the cooling water in the tube 54 is reduced. In alternative embodiments to the embodiments, therefore, at least one tube 54*a* is spaced from the front housing member 21 by a predetermined distance, as shown in FIG. 7. The distance by which the tubes 54*a* should be spaced from the front housing member 21 for preventing the above-described transmission of heat is found from the cooling capacity of the cooling medium as determined by the flow rate and temperature of the cooling medium in the tubes 54*a* and also from the flow rate and temperature of the discharge gas in the gas passage 53.

In the above-described embodiments, each tube 54*a* is shaped flat in cross-section. The shape of the tube 54*a* is not limited to flatness. In alternative embodiments to the embodiments, each tube 54*a* is cylindrical in cross-section, as shown in FIG. 7.

In the above-described embodiments, the inter-cooler 51 is constructed in such a manner that the cooling water flows inside the tubes 54*a* and that the discharge air flows outside the tubes 54*a*. In alternative embodiments to the embodiments, the discharge air may flow inside the tubes and the cooling water may flow outside tubes. In this case, with the tubes spaced from the front housing member 21 by a predetermined distance, as shown in FIG. 7, the cooling water flows around the gas passage 53. Therefore, the gas passage 53 and the back cooling chamber 41 are easily formed so as not to adjoin each other.

In the above-described embodiments, the electric motor M is cooled by the cooling water which flows in the water jacket 39. In alternative embodiments to the embodiments, the electric motor M may be made as air-cooled type so that the water jacket 39 is eliminated. In the alternative embodiment to the first preferred embodiment, the cooling water is fed from the water pump 38 to the back cooling chamber 41. In the alternative embodiment to the second preferred embodiment, the cooling water is fed from the water pump 38 to the back cooling chamber 41 and the inter-cooler 51 by two divided into flows.

In the above-described embodiments, the gas compressed by the compressor is air. It is noted, however, that gas is not limited to air, but, in alternative embodiments to the embodiments, the gas includes hydrogen that serves as a fuel for use in the fuel cell FC.

In the above-described embodiments, the cooling medium is water. The cooling medium is not limited to the water, but, in alternative embodiments to the embodiments, the cooling medium includes air.

In the above-described embodiments, the compressor is for use with the fuel cell in the electric vehicle. In alternative embodiments to the embodiments, the compressor is used with other fuel cells than that in the electric vehicle. In yet alternative embodiments to the embodiments, the compressor is not limited to be used with the fuel cell, but the compressor is a refrigerant compressor for use in a vehicle air conditioning apparatus.

In the above-described embodiments, the case 52 of the inter-cooler 51 is constructed in such a manner that its opening is covered by the front housing member 21 thereby to define therein the discharge-gas cooling chamber 52*a*. In alternative embodiments to the embodiments, the case 52 is provided with a cover which adjoins the front housing member 21 in such a manner that the case 52 itself defines therein the discharge-gas cooling chamber 52*a*. In this case, the tubes 54*a*, which adjoin the front housing member 21, adjoin the cover of the case 52.

In the above-described embodiments, the air filter 28 is arranged in the discharge port 20*c*. In alternative embodiments to the embodiments, the air filter 28 is arranged between the inter-cooler 51 and the fuel cell FC.

In the above-described embodiments, the power for driving the compressor thereby to compress the gas in the compression chambers 26 is supplied by the electric motor M provided in the compressor. In alternative embodiments to the embodiments, the power or running torque for driving the vehicle wheels is transmitted to the rotary shaft 13 through a belt.

The above-described embodiments are applied to a scroll type compressor. In alternative embodiments to the embodiments, however, the scroll type compressor is substituted by a compressor of other type such as a swash plate type piston compressor or a vane type compressor.

Therefore, the present examples and embodiments are to be considered as illustrative and not restrictive and the invention is not to be limited to the details given herein but may be modified within the scope of the appended claims.

What is claimed is:

1. A compressor, which is cooled by a cooling medium, comprising:

a compression chamber in which gas is compressed and then discharged therefrom;

a first cooling chamber, in which the cooling medium flows, provided so as to adjoin the compression chamber for cooling the gas in the compression chamber and to surround a discharge port for cooling the gas flowing therethrough; and a second cooling chamber adjoining the first cooling chamber, the second cooling chamber having a gas passage in which the discharged gas flows and a medium passage in which the cooling medium flows, the medium passage being arranged so as to restrain transmission of heat from the discharged gas in the gas passage to the cooling medium in the first cooling chamber, wherein the first cooling chamber is located between the medium passage and the compression chamber, and the cooling medium flows into the first cooling chamber and the medium passage.

2. The compressor according to claim 1, wherein the cooling medium is flowed from the first cooling chamber to the medium passage.

3. The compressor according to claim 2, wherein the medium passage is arranged in such a manner that the gas passage does not adjoin the first cooling chamber.

4. The compressor according to claim 2, wherein the medium passage is arranged in such a manner that the gas passage partially adjoins the first cooling chamber.

5. The compressor according to claim 2, further comprising an electric motor arranged in the compressor and a motor cooling member that covers the electric motor for cooling the electric motor, power for driving the compressor thereby to compress the gas in the compression chamber being supplied by the electric motor provided in the compressor, the cooling medium, which has flowed through the motor cooling member, being flowed into the first cooling chamber and the medium passage.

6. The compressor according to claim 5, wherein the motor cooling member is a water jacket.

7. The compressor according to claim 2, wherein the compressor compresses gas which is supplied to a fuel cell.

8. The compressor according to claim 2, wherein the medium passage includes a plurality of branched tubes through which the cooling medium flows, the gas passage being provided by space outside the tubes in the second cooling chamber, a fin being arranged in the gas passage.

9. The compressor according to claim 8, wherein each tube is flat in cross-section.

10. The compressor according to claim 8, wherein each tube is cylindrical in cross-section.

11. The compressor according to claim 8, wherein the tubes are spaced from the first cooling chamber by a predetermined distance.

12. The compressor according to claim 2, wherein the gas is one of air and hydrogen.

13. The compressor according to claim 1, wherein the cooling medium is divided into two flows so as to simultaneously flow into the first cooling chamber and the medium passage.

14. The compressor according to claim 13, wherein the medium passage is arranged in such a manner that the gas passage does not adjoin the first cooling chamber.

15. The compressor according to claim 13, wherein the medium passage is arranged in such a manner that the gas passage partially adjoins the first cooling chamber.

16. The compressor according to claim 13, further comprising an electric motor arranged in the compressor and a motor cooling member that covers the electric motor for cooling the electric motor, power for driving the compressor thereby to compress the gas in the compression chamber being supplied by the electric motor provided in the compressor, the cooling medium, which has flowed through the motor cooling member, being flowed into the first cooling chamber and the medium passage.

17. The compressor according to claim 16, wherein the motor cooling member is a water jacket.

18. The compressor according to claim 13, wherein the compressor compressed gas which is supplied to a fuel cell.

19. The compressor according to claim 13, wherein the medium passage includes a plurality of branched tubes through which the cooling medium flows, the gas passage being provided by space outside the tubes in the second cooling chamber, a fin being arranged in the gas passage.

20. The compressor according to claim 19, wherein each tube is flat in cross-section.

21. The compressor according to claim 19, wherein each tube is cylindrical in cross-section.

22. The compressor according to claim 19, wherein the tubes are spaced from the first cooling chamber by a predetermined distance.

23. The compressor according to claim 13, wherein the gas is one of air and hydrogen.

* * * * *